US008776968B2

(12) United States Patent
Higby

(10) Patent No.: US 8,776,968 B2
(45) Date of Patent: Jul. 15, 2014

(54) CABLE REEL AXLE SHAFT WITH INTEGRATED RADIO FREQUENCY ROTARY COUPLING

(75) Inventor: John P. Higby, Beverly, MA (US)

(73) Assignee: Raytheon Company, Waltham, MA (US)

( * ) Notice: Subject to any disclaimer, the term of this patent is extended or adjusted under 35 U.S.C. 154(b) by 812 days.

(21) Appl. No.: 13/033,958

(22) Filed: Feb. 24, 2011

(65) Prior Publication Data

US 2014/0062806 A1 Mar. 6, 2014

(51) Int. Cl.
*B66C 13/12* (2006.01)

(52) U.S. Cl.
USPC ..... 191/12.2 R; 191/12 R; 191/12.4

(58) Field of Classification Search
USPC ..... 191/12 R, 12.2 R, 12.2 A, 12.4; 343/707, 343/713
See application file for complete search history.

(56) References Cited

U.S. PATENT DOCUMENTS

| | | | | |
|---|---|---|---|---|
| 3,102,765 | A * | 9/1963 | Newman | 439/3 |
| 3,961,589 | A * | 6/1976 | Lombardi | 114/328 |
| 3,972,046 | A * | 7/1976 | Lombardi | 343/709 |
| 4,335,469 | A * | 6/1982 | Tharp et al. | 455/125 |
| 4,379,615 | A * | 4/1983 | Toda et al. | 385/147 |
| 4,426,665 | A * | 1/1984 | Bradford et al. | 386/316 |
| 4,473,917 | A * | 10/1984 | Britton | 15/104.94 |
| 5,754,220 | A * | 5/1998 | Smalser, Sr. | 348/84 |
| 6,460,795 | B1 * | 10/2002 | Brown, Jr. | 242/378.2 |
| 7,078,621 | B1 | 7/2006 | Carpenter, Jr. et al. | |
| 7,546,912 | B1 * | 6/2009 | Pack et al. | 191/12.2 A |
| 2002/0162671 | A1 | 11/2002 | Darveniza | |
| 2003/0122636 | A1 * | 7/2003 | DiBenedetto | 333/237 |
| 2006/0264921 | A1 * | 11/2006 | Deutsch et al. | 606/32 |
| 2007/0132842 | A1 * | 6/2007 | Morris | 348/82 |
| 2014/0062806 | A1 * | 3/2014 | Higby | 343/713 |

FOREIGN PATENT DOCUMENTS

| | | |
|---|---|---|
| EP | 1 551 086 | 6/2005 |
| EP | 2 073 305 A1 | 6/2009 |

OTHER PUBLICATIONS

Cavotec Product Catalogue; "CLT—Spring Driven Cable Reels;" Jul. 2006; pp. 1-16.
Cavotec Product Catalogue; "FLT—Spring Driven Cable Reels;" Nov. 2006; pp. 1-28.
Diamond Catalog; "Rotary Joints Satellite Communications;" catalog dated Apr. 2009; 20 pages.

(Continued)

*Primary Examiner* — Jason C Smith
(74) *Attorney, Agent, or Firm* — Daly, Crowley, Mofford & Durkee, LLP

(57) ABSTRACT

In one embodiment, a cable reel axle shaft is configured with a mounting member and an encased rotary coupling. In particular, a first end of the axle shaft at the mounting member comprises a stationary radio frequency (RF) connection (e.g., a stator), and another end of the axle shaft comprises a rotating RF connection (e.g., a rotor). The rotor-stator break may then be located within the axle shaft, illustratively within the member. In this manner, a rotary coupling is extended and integrated into the center of the structural axle shaft for the cable reel, such that an RF connection may be maintained throughout adjustment of an accompanying variable-length RF antenna while efficiently handling the changes in required RF cable length. This provides numerous benefits over individual components, such as decreased size and weight, increased RF performance, greater survivability, and ease of operation (e.g., to spool and unspool an RF cable).

21 Claims, 10 Drawing Sheets

(56) References Cited

OTHER PUBLICATIONS

Gleason Reels Catalog; "Heavy Duty Lift, Stretch and Retrieve Reels;" Series S and Series WB; CR-8; pp. 1-32.
Chelton Microwave, Kevlin Division; "Rotary Joints;" most current catalog as a hard cover book.
Notification of Transmittal of the International Search Report and the Written Opinion of the International Searching Authority, or the Declaration, PCT/US2012/020395 dated Apr. 12, 2012, 5 pages.
Written Opinion of the International Search Authority, PCT/Us2012/020395 dated Apr. 12, 2012, 3 pages.
U.S. Appl. No. 13/033,963, filed Feb. 24, 2011, Specification and Figures, 37 pages.
Notification Concerning Transmittal of International Preiiminary Report on Patentability (including International Prelimlnary Report on Patentability & Written Opinion of the ISA) dated Sep. 1, 2013, 5 pages.
Notification Concerning Transmittal of International Preliminery Report on Patentability (including international Preliminary Report on Patentability & Written Opinion of the ISA) dated Sep. 6, 2013, 9 pages.
Notification Concerning Transmittal of International Preliminary Report on Patentability (including International Preliminary Report on Patentability & Written Opinion of the ISA) dated Sep. 6, 2013, 5 pages.
Official Office Action from European Patent Office, Application No. 113610112-1951, PCT/US2011028848, dated Nov. 7, 2013, 2 pages.
Response to Official Office Action from European Patent Office, Application No. 115610302-1951, PCT/US2011028848, dated Nov. 7, 2013, 22 pages.
Notification of Transmittal of the International Search Report and the Written Opinion of the International Searching Authority, or the Declaration; PCT/US2012/020394, date of mailing Apr. 24, 2013, 4 pages.
Written Opinion of the International Searching Authority; PCT/US2012/020394, date of mailing Apr. 24, 2013, 9 pages.

* cited by examiner

CABLE REEL AXLE SHAFT WITH INTEGRATED RADIO FREQUENCY ROTARY COUPLING

FEDERALLY SPONSORED RESEARCH

This invention was made with Government support by the Department of Defense under UAE Patriot Contract No. W31P4Q-09-G-0001. The Government has certain rights in the invention.

TECHNICAL FIELD

The present disclosure relates generally to cable reel axle shafts and to radio frequency (RF) cable connections.

BACKGROUND

There exist many situations where it is desirable to have a variable length radio frequency (RF) connection. For instance, many RF antennas, such as for news vans or other mobile antenna platforms, have a variable-length (e.g., height) RF antenna, where one end of an RF cable is attached to the variable-length RF antenna, and another end is attached to a stationary opposite end.

To date, to allow the RF cable to accommodate the adjustable-length RF antenna, a variety of techniques have been used. In one technique, the maximum amount of needed RF cable according to the maximum length of the antenna is connected, and when the length of the antenna is anything other than the maximum length, the excess cable is manually coiled on a vertical surface in the shape of a side-ways figure eight held up by a pair of lobes or hooks. Excess cable can also be stored horizontally by coiling it inside a protective enclosure (often referred to as a "cable coffin"), as neatly as the operator is capable of accomplishing. In another technique, a cable reel may be used to spool and unspool the RF cable in response to the adjusted length of the RF antenna, however, due to the rotation of the cable reel, an operator has to manually disconnect and reconnect the RF cable end whenever the antenna height is adjusted. Both of these two manual techniques pose great inconveniences to the operators, and result in increased set-up (emplacement) and tear-down times of the antennas.

In another known technique, the RF cable may be wound around the adjustable-length RF antenna in a generally helical (spiraling/coiling) manner, much like a television news truck. As the RF antenna is extended (e.g., raised), the RF coil expands like a spring around the antenna (e.g., a mast on which the antenna rests). As the RF antenna is shortened (e.g., lowered), the RF coil compresses. While this arrangement may be suitable for certain situations, such as low power and/or low frequency transmissions, as will be appreciated by those skilled in the art, RF cable length is a great contributor to line loss, typically expressed in decibels (dB). In addition to cable length, line loss in a given cable is a function of the dielectric material between the center and outer conductor, the diameter of the center conductor, the diameter of the outer conductor, and also the frequency. Lower frequency communications such as VHF (below 300 MHz frequency) have less line loss for a given length than higher, microwave frequencies (e.g., C-Band or X-Band). For example, using a premium, high-performance, large diameter cable, approximate loss may be characterized for high frequency transmissions as 1 dB of signal loss for every 20 feet of RF cable. Due to the spiraling nature of this particular alternative, the length of the RF cable is roughly eight to ten times the maximum length (e.g., height) in order to allow the proper expansion of the RF cable spiral to match the length of the variable-length antenna. In addition to other signal losses, such as from weather, interference from jamming, line of site, curvature of the earth, etc., the signal loss due to the extra cable length may be significant and unsatisfactory (e.g., particularly to maintain a high baud rate over the RF transmission).

Additionally, slip-rings may be used for certain classes of cable reels, such as multi-conductor power, discrete controls, and low frequency communications, often found on harbor and boom cranes. For this a slip-ring is typically enclosed in an environmental housing, sized for the number of channels (conductors) and current carrying capability required by the load. Typical slip-ring housings for a cable reel (e.g., a 10-inch wide cable reel supporting 1-inch diameter cable), however, are approximately 6-8 inches in diameter and 8-10 inches high. This extra size and weight may pose particular difficulty to mobile applications. Slip-ring frequency capability is limited by the geometry of the ring and brush assembly, as may be appreciated by those skilled in the art, has a cut-off limit of approximately 100 kHz. For this reason slip rings are typically not used for RF communications.

For higher frequency RF communications an RF rotary coupling is typically used. These devices are designed specifically for higher frequencies and use contacting (single channel) or wave-guide (multi-channel) architectures. As with slip rings, implementation of an RF rotary coupling with a cable reel requires a suitable environmental enclosure. The weight and volume requirements for a 1-inch diameter high-performance coaxial cable are approximately the same as a slip-ring for a power cable of the same size. The additional volume and weight required poses great difficulty to mobile applications.

SUMMARY

According to one or more embodiments of the invention as described herein, a cable reel axle shaft is configured with a mounting member (e.g., flange) and an encased rotary coupling. In particular, a first end of the axle shaft at the mounting member comprises a stationary radio frequency (RF) connection (e.g., a stator), and another end of the axle shaft comprises a rotating RF connection (e.g., a rotor). A rotor-stator break may then be located within the axle shaft, illustratively within the mounting member. In this manner, a rotary coupling is extended and integrated into the center of the structural axle shaft for the cable reel, e.g., a spring-loaded cable reel, such that an RF connection (e.g., high frequency) may be maintained throughout adjustment of an accompanying variable-length RF antenna while efficiently handling the changes in associatively required RF cable length.

Accordingly, the example cable reel axle shaft with integrated RF rotary coupling is smaller and lighter than individual components, eliminates the need for external housings and additional seals, provides a reduced RF line loss from the rotor to the stator connector that is much lower than normal (particularly due to fewer interfaces and dielectric materials used in the rotary coupling/axle shaft body), and provides improved survivability for lightning strikes or other electromagnetic pulses. Further, the use of an integrated RF rotary coupling within the structural axle shaft eliminates the need for manual operator intervention to spool and/or unspool the cable reel, such as when raising and/or lowering an associated variable-length antenna.

According to one or more embodiments of the disclosure, an apparatus comprises a mounting member having a first and second side, the first side configured to mount to a structure in stationary relation with the structure. The apparatus also comprises an axle shaft having a first end and second end, the first end affixed to the second side of the mounting member, the axle shaft configured to mate with a center aperture of a cable reel such that the cable reel rotates around the axle shaft. In addition, a stationary radio frequency (RF) connection is located at the first side of the mounting member, while a rotating RF connection is located at the second end of the axle shaft. An RF rotary coupling break (rotor-stator break) is enclosed within one of either the mounting member or the axle shaft, the rotary coupling break configured to establish RF connectivity between the stationary RF connection and the rotating RF connection.

In one embodiment, the apparatus further comprises a bracket attached to the rotating RF connection and configured to attach to the cable reel, wherein the bracket is configured to transfer rotational force from the cable reel to the rotating RF connection.

In one embodiment, the apparatus further comprises a spring-loading connection configured to attach to a spring to spring-load the cable reel. In one embodiment, the spring-loading connection is a keyway, or a first substantially straight groove located axially along an exterior wall of the axle shaft and configured to accept a key or pin inserted between the first substantially straight groove and a second substantially straight groove located axially along an interior wall of a mating spring shaft to lock the spring shaft substantially in place with relation to the axle shaft.

In one embodiment, the RF rotary coupling break is configured for a single RF channel.

In one embodiment, the rotating RF connection comprises a coaxial connection that extends through the axle shaft, and the apparatus comprises an air dielectric within the axle shaft between an external shield of the coaxial connection and a center conductor of the coaxial connection.

In one embodiment, the axle shaft and mounting member each comprise a conductive material. In one embodiment, the conductive material of the axle shaft is configured to conductively attach to an external coaxial shielding of an RF cable via the rotating RF connection.

In one embodiment, the apparatus further comprises seal seats at the first end and second end of the axle shaft configured to accept corresponding seals with respect to the cable reel.

In one embodiment, the mounting member is a flange.

According to one or more additional embodiments of the disclosure, a system comprises a cable reel having a center aperture about a rotating axis of the cable reel, and an RF rotary coupling axle shaft configured to mate with the center aperture of the cable reel such that the cable reel rotates around the axle shaft. In particular, the axle shaft has a first and second end, and comprises: a mounting member configured at the first end to mount to a structure in stationary relation with the structure; a stationary RF connection at the first end; a rotating RF connection at the second end; and an RF rotary coupling break enclosed within the mounting member and configured to establish RF connectivity between the stationary RF connection and the rotating RF connection.

In one embodiment, the system further comprises an RF cable spooled around the cable reel, the RF cable connected to the rotating RF connection. In one embodiment, the system comprises a variable-length RF antenna, wherein the RF cable is attached to the variable-length RF antenna at a distal end from the cable reel. In one embodiment, the system comprises a mobile antenna platform on which the variable-length antenna is mounted.

In one embodiment, the system further comprises a bracket attached to the rotating RF connection and configured to attach to the cable reel, wherein the bracket is configured to transfer rotational force from the cable reel to the rotating RF connection.

In one embodiment, the system further comprises a spring attached to the axle shaft and cable reel to spring-load the cable reel. In one embodiment, the axle shaft comprises a first substantially straight groove or keyway located axially along an exterior wall of the axle shaft, and wherein the spring comprises a spring shaft having a second substantially straight groove or keyway located axially along an interior wall of the spring shaft, and the system further comprises a key or pin inserted between the first substantially straight groove and the second substantially straight groove to lock the spring shaft substantially in place with relation to the axle shaft.

In one embodiment, the system further comprises a first seal between the axle shaft and the cable reel at the first end of the axle shaft, and a second seal between the axle shaft and the cable reel at the second end of the axle shaft.

In one embodiment, the system further comprises a second mounting member attached to the cable reel approximate to the second end of the axle shaft, the second mounting member configured to establish rotating attachment of the cable reel to the structure.

According to one or more embodiments of the disclosure, a method comprises: mounting a cable reel onto a radio frequency (RF) rotary coupling axle shaft such that the cable reel rotates around the axle shaft; mounting a mounting member of the axle shaft to a structure in stationary relation with the structure, the mounting member enclosing an RF rotary coupling break that is configured to establish RF connectivity between a stationary RF connection at the mounting member and a rotating RF connection at an end of the axle shaft opposite the mounting member; connecting a first RF cable that is spooled around the cable reel to the rotating RF connection; and connecting the first RF cable at an end opposite the rotating RF connection to a variable-length RF antenna.

In one embodiment, the method further comprises connecting a second RF cable to the stationary RF connection.

BRIEF DESCRIPTION OF THE DRAWINGS

The embodiments of the invention herein may be better understood by referring to the following description in conjunction with the accompanying drawings in which like reference numerals indicate identically or functionally similar elements, of which.

DESCRIPTION OF EXAMPLE EMBODIMENTS

A cable reel assembly with a radio frequency (RF) rotary coupling axle shaft in accordance with one or more embodiments described in detail below may be utilized in a variety of different situations. For example, any equipment utilizing a variable-length tower that requires an RF connection (e.g., antennas, satellite dishes, etc.) may utilize the system herein. For instance, while a standalone adjustable-length antenna may be used, the system and techniques herein may be particularly useful with any equipment having a correspondingly adjustable-length (e.g., height) mast, tower, etc., such as raised platforms, forklifts, etc., that require a correspondingly adjustable-length RF cable connection. Also, the system may be stationary at a single geographic location, or may be used with mobile systems, such as those that require adjustable-lengths to assist in mobility.

Figure 1:
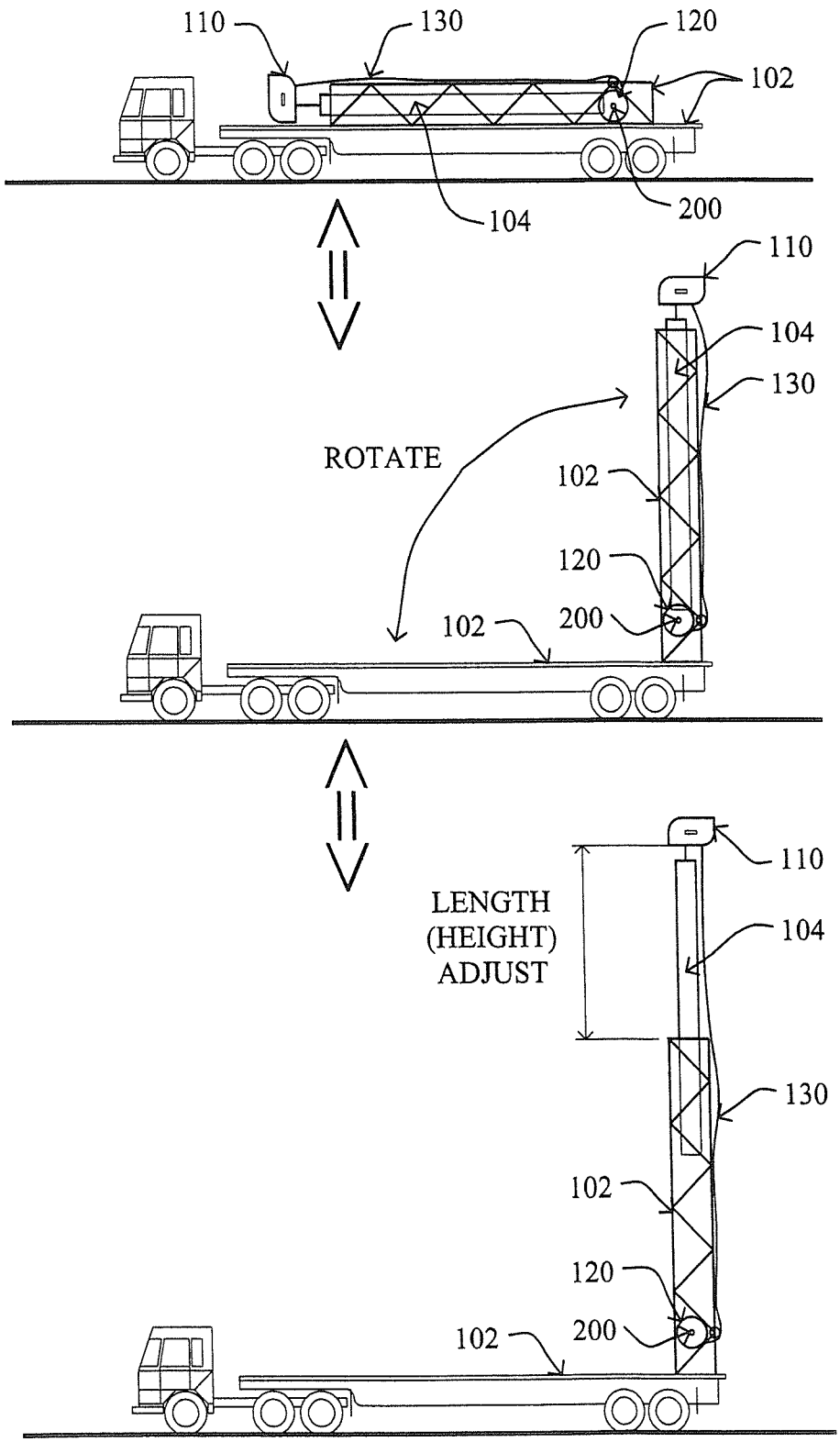
FIG. 1 illustrates an example mobile antenna deployment.

FIG. 1 illustrates an example of a mobile payload that may be used in accordance with one or more embodiments herein. In particular, as one example implementation, a structure 102 comprises a truck (or other land vehicle) and/or support structure that may be configured to carry an adjustable-length (e.g., height) payload 104, such as an antenna mast, a mobile telecommunications tower, etc., such as for mobile deployment (e.g., rapid response, disaster relief equipment, etc.) of the payload 104 to a desired location. An antenna 110 (or satellite dish, or other RF device), may be placed atop the adjustable-length payload 104 (mast, tower, etc.), or else may simply be the payload itself. A first RF cable 130 attached to the antenna 110 (at a distal end of the cable 130 with respect to cable reel) may be spooled around a cable reel 120, illustratively at the base of the payload 104. Note that as used herein, a fixed-length antenna 110 located at the end of an adjustable-length payload 104 is considered an adjustable-length RF antenna, the adjustable length in relation to cable reel 120.

As shown in FIG. 1, the payload 104 may rotate at its base (if necessary), and may extend and retract according to operator commands, such as based on electrical and/or hydraulic control, etc., adjusting its length (e.g., height) in relation to its base. Note that while the cable reel axle shaft system has been shown generally for land-based deployment of mobile antenna platforms on which a variable-length antenna is mounted (trucks, towers, buildings, etc.), watercraft (e.g., boats) may also utilize the system in accordance with embodiments herein. For instance, an adjustable-length antenna may be mounted on the top of a mast or superstructure. Note that while an adjustable-length antenna is shown, the embodiments herein may also be used with other devices, such as radio telescopes, e.g., that have variable azimuth and/or elevation positions, etc.

According to one or more of the embodiments herein, a cable reel assembly with a radio frequency (RF) rotary coupling axle shaft 200 may be used to alleviate the need to manually reestablish RF cable connections (and/or to manually stow RF cable on hangers or within a protected enclosure) for adjustable-length payloads 104, such as masthead mounted equipment used in telescoping towers. Accordingly, for mobile payloads, the system allows a reduced emplacement (set-up) and tear-down (e.g., "road-march") time, where antennas stay permanently connected to the RF units (transceivers), and can be deployed across surrounding terrain without re-making connections. Also, the integration of the RF rotary coupling within the axle shaft 200 allows for a reduced size and weight when compared to individual rotary coupling components or when compared to various slip-rings currently available. Further, the spooled cable reel is much shorter than, and thus there is much less loss than, a spiraled RF cable up the tower 104.

Figure 2A:
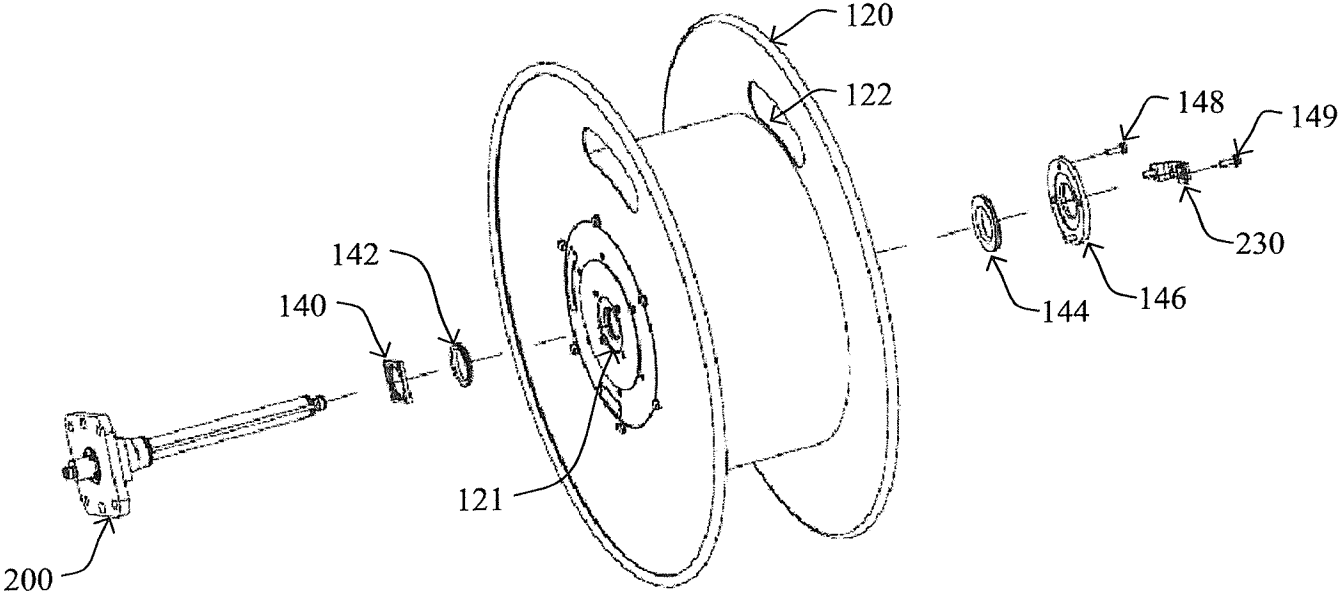
FIGS. 2A-B illustrate example cable reel assemblies with RF rotary coupling axle shafts.

FIG. 2A illustrates an example (exploded) cable reel assembly with an RF rotary coupling axle shaft 200 in accordance with one or more embodiments described herein. In particular, an illustrative cable reel 120 has a center aperture 121 about a rotating axis of the cable reel, and at least one sidewall aperture 122 through which an RF cable may be placed. (Notably, the placement of aperture 122 is merely illustrative; other configurations are suitable for use with the invention herein. Also, an aperture shown opposing aperture 122 may be used for purposes other than cable egress, such as for lifting straps to ease installation of the cable reel.) The axle shaft 200 may be inserted through the cable reel center aperture 121, and various hardware, such as a shim 140, seals 142 and 144, seal retainers 146, and mounting hardware 148/149, may be used to secure the cable reel 120 to the axle shaft 200. Seals 142 and 144 between the axle shaft 200 and cable reel 120 at ends of the axle shaft, in particular, may be incorporated to prevent fluid/chemical ingress to the interior of cable reel 120. Also, in one or more embodiments, as described below, a drive bracket 230 may be used to connect the cable reel 120 to the axle shaft 200 (e.g., a rotational portion thereof).

Figure 2B:
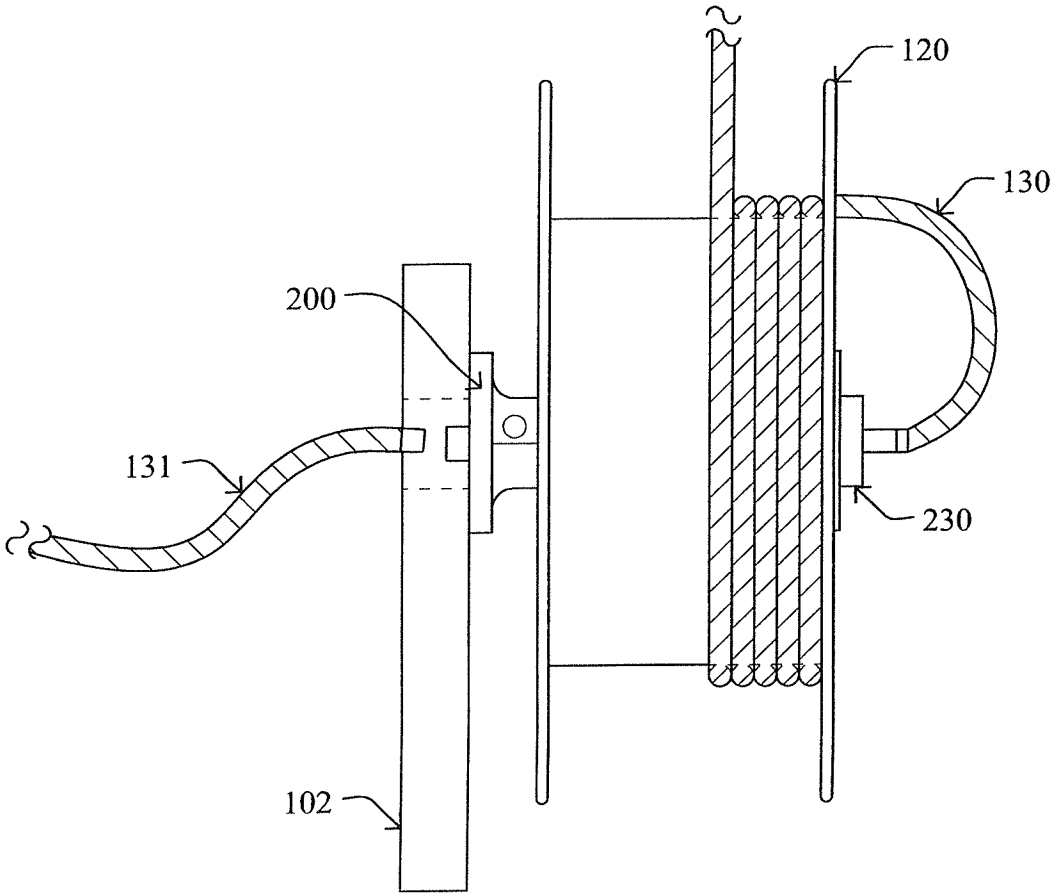

FIG. 2B illustrates an alternative view of the cable reel assembly in an example assembled form. For instance, RF cable 130 is shown spooled around the reel 120 in a parallel lay configuration as shown, where the side plates/walls of the reel are arranged such that each winding of the cable (other than end windings) essentially lies next to a previous winding. Alternatively, the RF cable 130 may be mono-spiraled around the reel 120, in which the reel has side plates spaced approximately one cable-width apart, such that the cable coils (spools) on top of itself in a tight spiral. An example RF cable, as will be appreciated by those skilled in the art, is a conventional coaxial cable with external shielding and a center/core conductor (e.g., solid or stranded copper) separated from the external shielding by a dielectric. For high frequency ultra-low-loss RF communication, an example size of the RF cable 130 is approximately 1-inch in diameter.

The RF cable 130 is shown passing through aperture 122, and interconnecting with the inserted axle shaft 200 at a protruding end (e.g., an end secured by drive bracket 230). At the other end the RF rotary coupling axle shaft 200 may be affixed to an unmoving structure 102 (with respect to the adjustable-length antenna 110). At this end of the axle shaft, as described in more detail below, a second RF cable 131 may be attached, e.g., illustratively leading to some RF unit/transceiver to which the antenna 110 is to be communicatively attached. The cable reel 120, rotating around the axle shaft 200, is configured to spool and unspool the first RF cable 130 in response to movement of the adjustable-length antenna 110, and as described herein, the first RF cable 130 and second RF cable 131 remain in conductive (communicating) contact during the rotation of the cable reel 120 through the RF rotary coupling axle shaft 200.

Figure 3A:
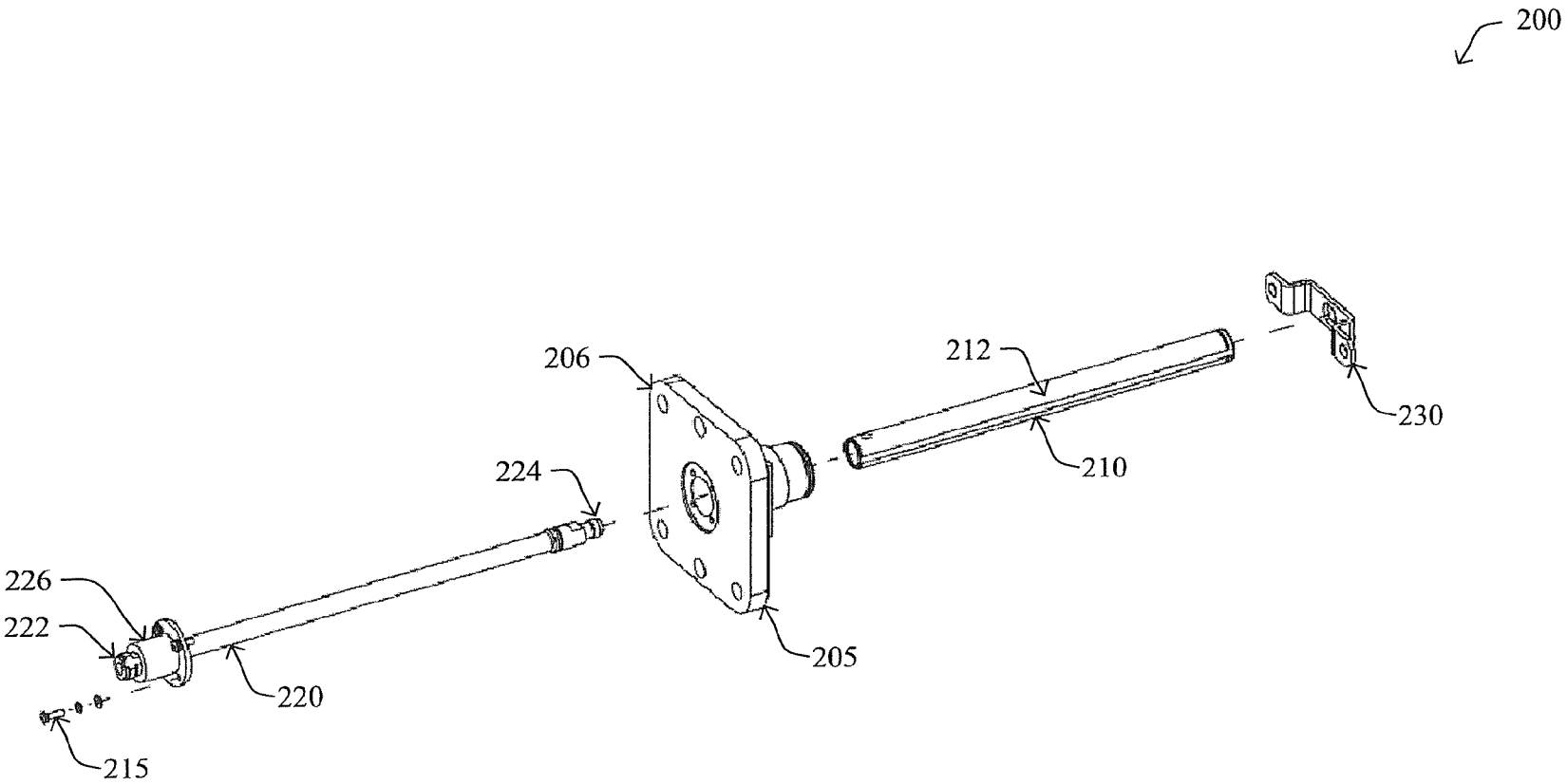
FIGS. 3A-B illustrate example RF rotary coupling axle shafts.

FIG. 3A illustrates an example expanded view of an RF rotary coupling axle shaft 200 in accordance with one or more embodiments of the invention herein. Specifically, a mounting member 205 (e.g., a flange) may have one or more apertures 206 such that the mounting member may be mounted to a structure (e.g., 102) in stationary relation with the structure (at a first side (showing) of the mounting member). An extended hollow shaft or "pipe" 210 (shown with groove 212, described below) may be affixed to the mounting member (at a side of the mounting member opposite the first side), through which rotary coupling elements 220 may be inserted. The pipe 210 may be manufactured by machining a centrally axial aperture through a solid shaft, or else may be rolled, stamped, extruded, etc.

In particular, rotary coupling elements 220 may comprise a stationary RF connection 222 at the mounting member side of the axle shaft 200 and a rotating RF connection 224 at an opposite end of the axle shaft 200, extending through and protruding from pipe 210 (to bracket 230). The stationary RF connection 222 (e.g., a stator) and rotating RF connection 224 (e.g., a rotor) are interconnected by an RF rotary coupling break 226 (e.g., a rotor-stator break). The assembly of rotary coupling elements may be affixed to (and, e.g., enclosed within) the mounting member 205 by hardware 215.

Figure 3B:
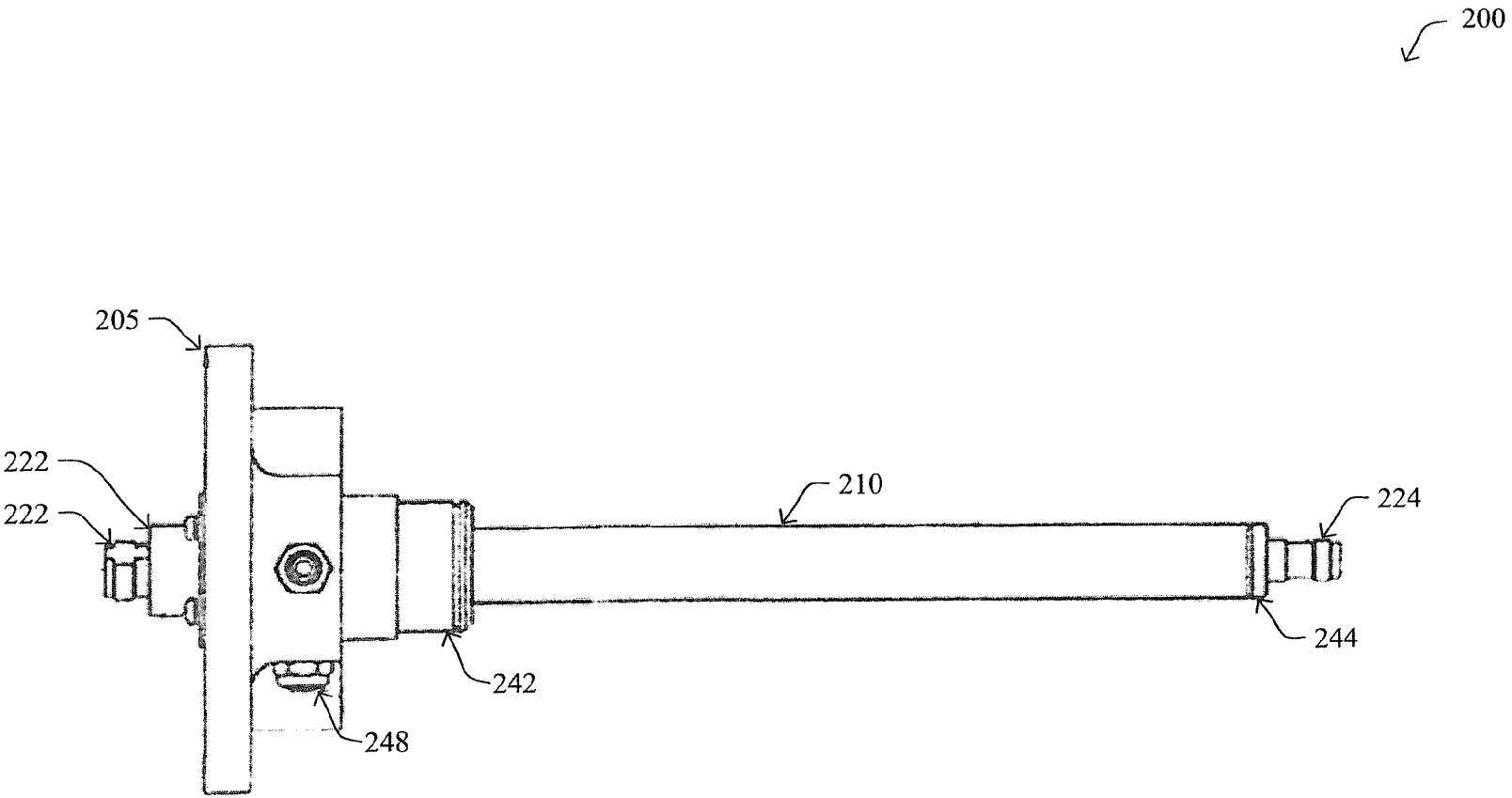

FIG. 3B illustrates an example axle shaft 200 of FIG. 3A in assembled form. Illustratively, mounting hardware 248 (e.g., set screws) may be used to secure the pipe 210 to the mounting member 205. Alternatively or in addition, the pipe 210 may be threaded to screw into the mounting member 205.

Note that the axle shaft 200 is insertable into the center aperture 121 of a cable reel 120 such that the cable reel rotates around the axle shaft 200. The size of the shaft 200 may be the same at both mating ends, however, as shown, the different ends of the shaft 200 may be sized differently. For example, a mounting member side of the pipe 210 may be larger than the opposing end to withstand forces created by the cable reel 120 at the mounting member side of the shaft. In addition, seal seat 242 at a first end of the pipe 210 may be larger than a seal seat 244 at a second opposite end, since the seal seats are configured to accept corresponding seals 142 and 144, respectively.

Note also that the size of the mounting member 205 and pipe 210 may depend generally upon the forces encountered by each component, and that the views shown herein are not scaled drawings, and are not meant to be limiting to the scope of the invention. For instance, the structural rotational connection with the cable reel 120 may occur at one particular end of the axle shaft 200, e.g., nearer to the mounting member, rather than at both ends. Also, while the cable reel 120 is generally described as rotating around the axle shaft 200, the actual rotational connection may be located as part of the mounting member 205 itself. That is, the pipe 210 may merely be configured to extend the length of the rotating RF connection 224 through to the other side of the cable reel 120, and the cable reel 120 rotates around axle shaft 200 about a cylindrical portion of the mounting member 205.

The stationary RF connection (e.g., stator) 222 is configured to connect with a generally stationary RF cable 131, while rotating RF connection (e.g., rotor) 224 is configured to connect with a rotating RF cable 130 (based on cable reel 120's rotation). As noted, the RF cable is illustratively a coaxial cable, and as such, the connections may comprise a specific corresponding "sex" (male or female), and type (e.g., RCA, UHF, F, BNC, TNC, 7/16 DIN, GR874, GR900BT, C, Type N, SMA, APC-7, tip-sleeve, tip-ring-sleeve, or 2.4 mm, etc., each as will be understood by those skilled in the art).

RF rotary coupling break 226 is configured to establish RF connectivity between the stationary RF connection 222 and the rotating RF connection 224, and may be enclosed (embedded) within one of either the mounting member or the axle shaft. By integrating the rotor-stator break 226 into the cable reel axle shaft 200 (e.g., mounting member 205), the cable reel motion drives the rotary coupling break 226 without stressing the cable or connectors.

Figure 4B:
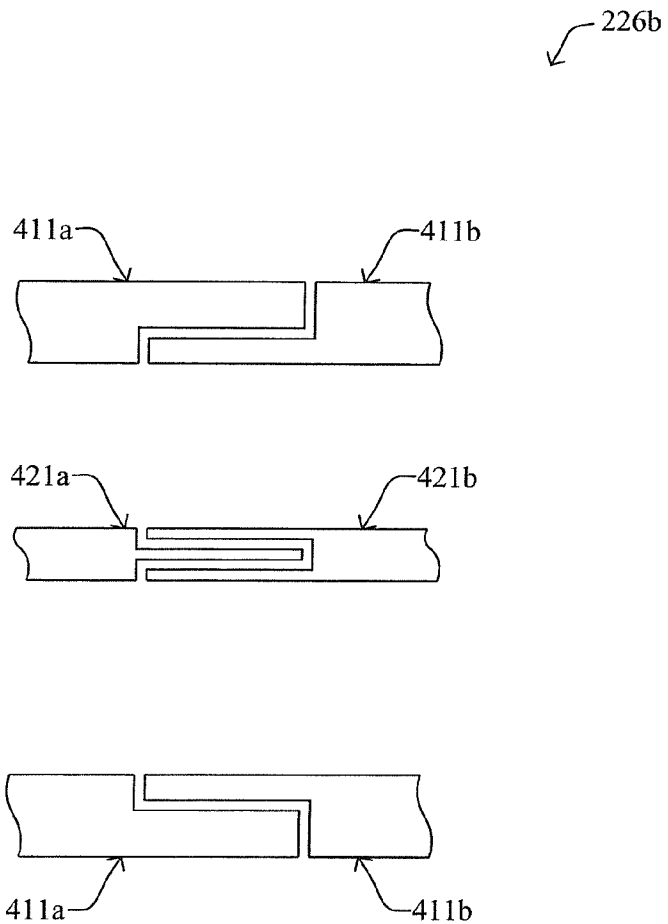
FIGS. 4A-B illustrate example RF rotary coupling breaks.
Figure 4A:
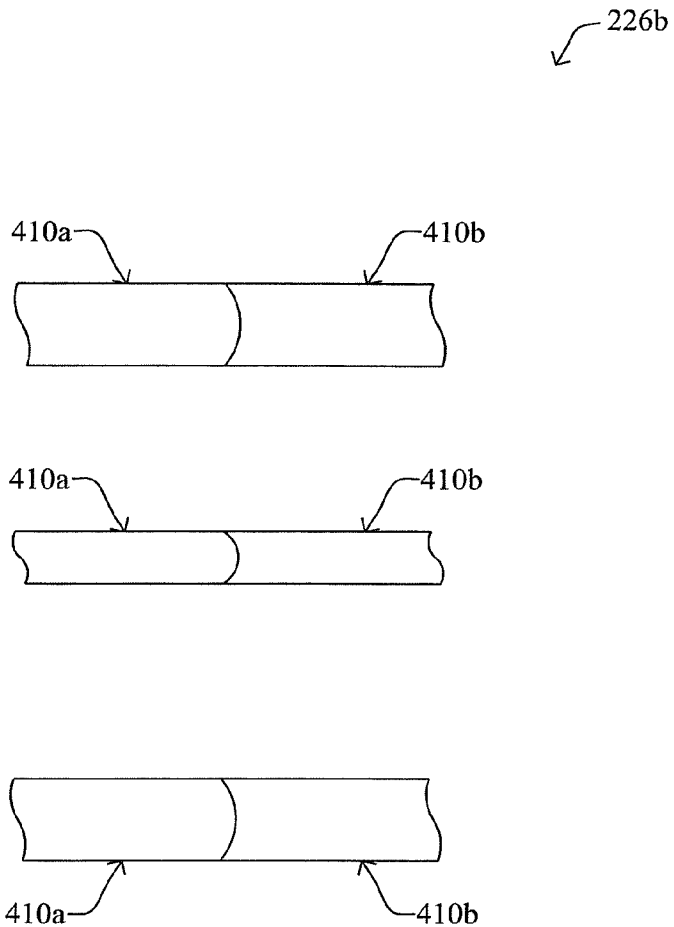

A rotary joint is a coaxial or waveguide transmission line that has the ability to pass an RF signal through a rotating interface, generally without excessive loss or distortion. RF rotary joints, regardless of complexity, include two basic elements: a rotor that rotates and a stator that remains stationary (e.g., connected by ball bearings), which are interconnected at a break. FIGS. 4A and 4B illustrate example RF rotary coupling breaks 226 (226*a* and 226*b*, respectively) that may be used within the cable reel axle shaft 200 described herein between the stationary RF connection 222 and the rotating RF connection 224.

For instance, FIG. 4A illustrates a cross section of an RF contacting junction 226*a* (e.g., configured for a single RF channel), which provide a broadband frequency response, with a low impedance RF contact at a rotational interface. In particular, an external shielding 410*a* of a stator connection (e.g., 222) may remain in rotational contact with an external shielding 410*b* of a rotor connection (e.g., 224). The center conductor (pin) 420*a* of the stator also remains in rotating contact with the rotor's center conductor 420*b* as the conductor 420*b* rotates in response to cable reel rotation as described herein. Note that the curvature of the connection between the components is merely illustrative, and that the view shown is a simplified representation for purpose of discussion.

Alternatively, FIG. 4B illustrates a cross section of an RF choke coupling 226*b* that may be used for the break 226 of the axle shaft 200 herein. In particular, in a choke coupling, a "choke" allows relative rotation of the two sections while providing electrical continuity across an open interface, thus without physical contact. For example, here, an external shielding 411*a* of a stator connection (e.g., 222) may remain a small distance away from an external shielding 411*b* of a rotor connection (e.g., 224), and the same is true for the center conductor (pin) 421*a* of the stator and the rotor center conductor 421*b*. In this instance, the gap (choke) between the elements (e.g., a minimal gap distance for approximately a ¼ wavelength length of the elements) is configured to still allow a communicative relationship between the elements, without requiring the elements to rotationally contact (e.g., wearing over time). Note also that the shape of the choke (gap) between the components is merely illustrative, and that the view shown is a simplified representation for purpose of discussion. Further, it will be understood that non-contacting rotary couplings are generally not capable of passing DC (direct current), and this is a factor in the selection of rotary joint style, as certain antennas may use a DC offset to provide power and signal on the same conductor.

Referring again generally to FIG. 3A, the rotary coupling elements 220, particularly the rotating RF connection 224 extending from the break 226 (e.g., for the length of the pipe 210), may comprise a rigid shaft/tube having an air dielectric between an external shield of the coaxial connection and a center conductor of the coaxial connection for superior performance over conventional flexible coaxial cable. This illustrative embodiment, in addition to the fact that the rotating cable 130 interfaces directly with the rotating RF connection without adapters or short lengths of interfacing cables (i.e., no necessary intermediate connections), results in a low loss solution, as each RF connection generally presents a certain loss to the system. Alternatively, the shaft/tube of the rotating RF connection 224 extending from the break 226 may comprise a flexible dielectric (such as a cable), which may allow for greater shock loads (i.e., larger deflections), than a rigid shaft/tube, particularly in a cantilevered design (e.g., as shown in FIG. 2B above).

Figure 5:
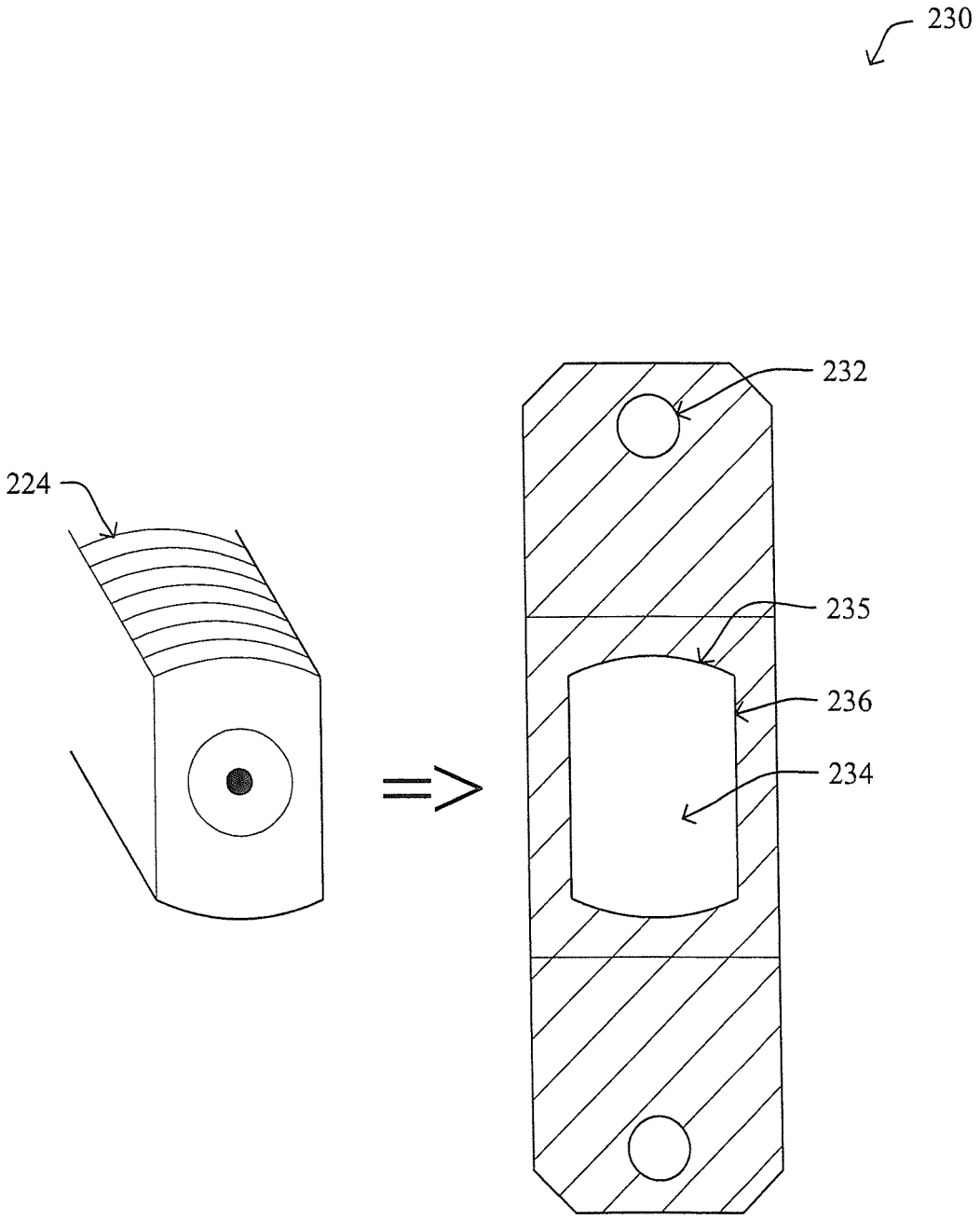
FIG. 5 illustrates an example drive bracket.

Notably, with reference still to FIG. 3A and additionally FIG. 2B, a drive bracket 230 may be attached to the rotating RF connection 224 and also to the cable reel 120. In this manner, the bracket is thus configured to transfer rotational force from the cable reel 120 to the rotating RF connection 224, without stressing the cable 130. In particular, as shown in FIG. 5, the drive bracket 230 may illustratively comprise mounting apertures 232 to allow mounting/attachment to the cable reel 120, and an RF connection aperture 234 configured to mate with the rotating RF connection 224. For instance, as shown, in order to provide the rotational connectivity between the bracket 240 and the rotating RF connection 224, the aperture 234 may comprise certain geometric shapes, such as the simple shape shown with a rounded or curved portion 235 to allow a correspondingly rounded portion (e.g., threads or other coaxial connection rounded connections) of rotating RD connection 224, and a straightened portion 236 to transfer rotational torque from the cable reel 120 to the similarly shaped portions of connection 224.

Moreover, according to certain embodiments herein, the cable reel 120 may be configured to manage the excess length of the spooled RF cable 130, such as to reduce slack in the cable 130. For instance, as shown in the cross-section of FIG. 6A, the cable reel 120 may be spring-loaded, such that a spring 160 is attached to the cable reel 120 and wraps around an axle 200 (which itself is attached to the structure 102). In this manner, as will be understood by those skilled in the art, the cable reel 120 (e.g., self-retracting) provides adequate tension around the affixed axle to pull back on any cable slack in order to spool excess cable when the antenna's length is shortened, and provides proper resistance to unspooling when the antenna's length is extended.

Figure 6B:
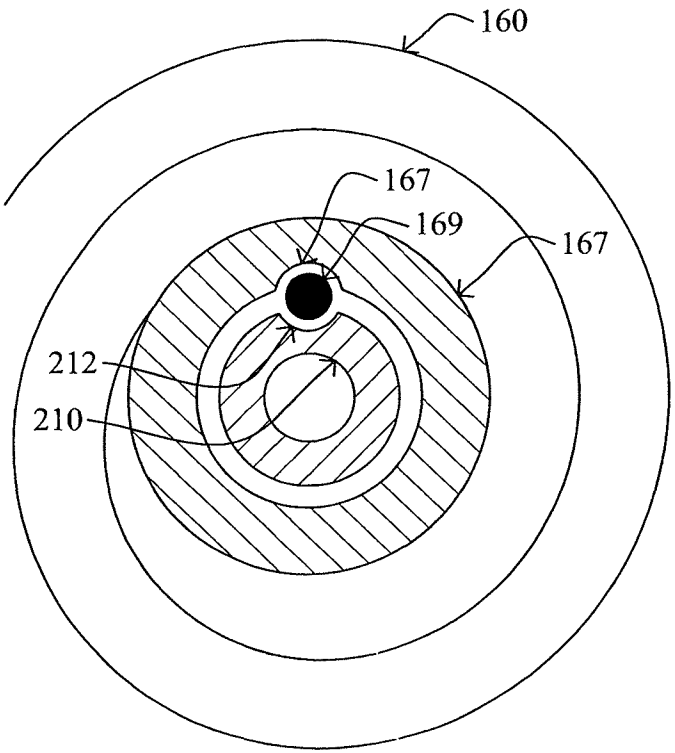
FIGS. 6A-B illustrate example spring-loading mechanisms.

Illustratively, FIG. 6B shows one embodiment of a spring-loading connection configured to attach to the spring 160 (and axle 200) to spring-load the cable reel 120. In particular, with reference to FIG. 3A also, the spring-loading connection may be a first substantially straight groove or keyway 212 located axially along an exterior wall of the axle shaft 200 (pipe 210) that is configured to accept a key or pin 169 (e.g., dowel) inserted between it and a second substantially straight groove 167 located axially along an interior wall of a mating spring shaft 165 (of spring 160). By inserting the pin 169 in this manner, the spring shaft 165 (and hence spring 160) is substantially locked in place with relation to the axle shaft 200 (pipe 210).

Figure 7:
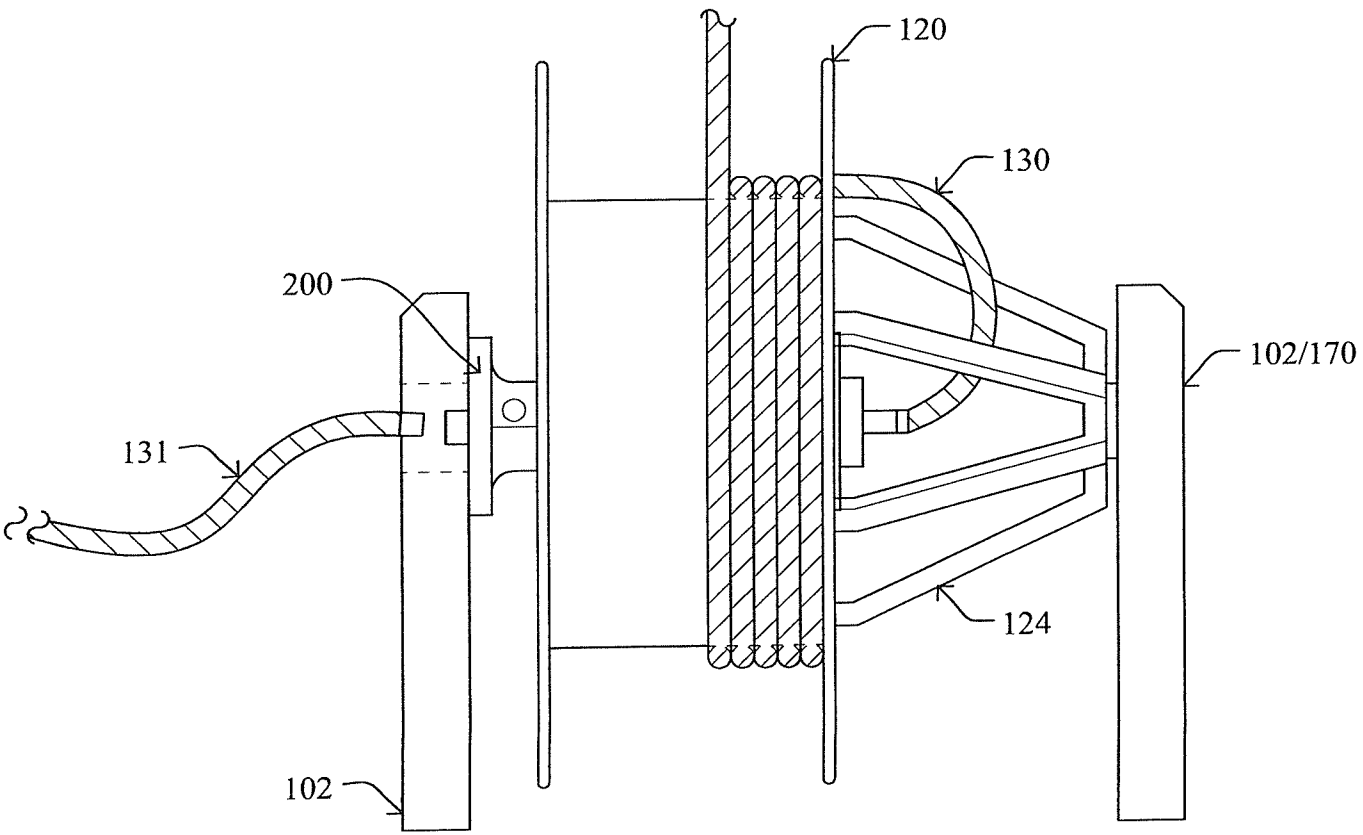
FIG. 7 illustrates another example cable reel assembly with an RF rotary coupling axle shaft.

FIG. 7 illustrates an example alternative embodiment of a cable reel assembly with an RF rotary coupling axle shaft 200, particularly where both sides of the cable reel 120 are structurally attached to a structure 102, e.g., to account for the weight of the cable reel 120 (and cable 130) for g-force shocks during travel of the structure 102 in a non-cantilevered design. In particular, a second mounting member 124 may be attached to the cable reel 120 (e.g., approximate to the second end of the axle shaft 200), where the second mounting member is configured to establish rotating attachment of the cable reel to the structure 102. RF cable 130 may be inserted through the rotating mounting member 124, such that the RF cable 130 and rotating mounting member 124 rotate simultaneously in relation to each other and the cable reel 120. Note that the actual configuration of the second/rotating mounting member 124 is merely an illustrative example, and is not meant to limit the invention herein.

Figure 6A:
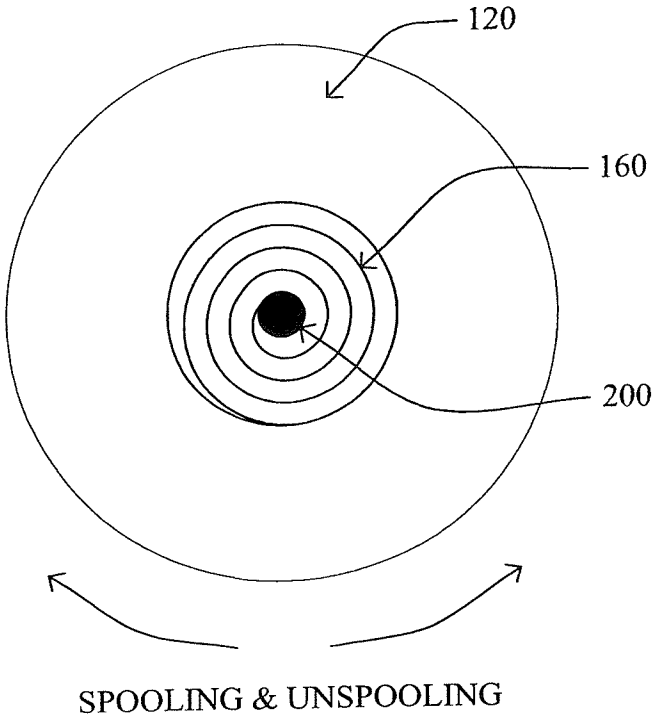

Additionally, FIG. 7 alternatively illustrates one or more alternative and/or additional embodiments, where through the use of a second mounting member 124, the cable reel 120 may be powered by a motor 170 (in place of structure 102 in FIG. 7), as an alternative to (or addition to) spring-loading the cable reel as in FIGS. 6A-B above. In particular, a motor 170 may be used to assist the spooling and unspooling of the reel 120, such that user/operator input may be supplied to control the motor (e.g., spool or unspool). Note that in one embodiment, the input/control is based on direct user interaction, where an operator specifically commands the motor to turn the cable reel 120. In another embodiment, however, the motor may be configured to spool the cable reel in response to an input to the antenna to shorten its length and to unspool the cable reel in response to an input to the antenna to extend its length. In other words, if an operator adjusts the length (e.g., height) of the antenna 110, then the cable reel 120 may automatically be spooled and/or unspooled by the motor 170 in response to the control of the antenna. Notably, while the motor 170 is shown spinning the second mounting member 124, other arrangements may be used, such as belt and pulley systems, gears, chains, etc., and the direct connection is merely an illustrative example.

According to one or more embodiments herein, the axle shaft 200 may also provide improved survivability for nearby lightning strikes or EMP (electro-magnetic pulse) events or other transient currents. For instance, in embodiments where the axle shaft 200 (and mounting member 205) comprise a conductive material such as metal, steel, aluminum, stainless steel, etc., the relatively sensitive rotor-stator break 226 may be substantially protected within the shell of the axle shaft 200 (e.g., mounting member 205). In other words, where the material of the axle shaft is configured to conductively attach to an external coaxial shielding of an RF cable 130 via the rotating RF connection 224, the outer conductor of the rotary break is in close contact to the conductive pipe 210 and/or mounting member 205, affording the break an inherent protection against transient currents from the antenna 110 (e.g., relaying the transient current along the external shielding of RF cable 130 to the cable reel 120 and/or structure 102).

Based on the configurations of one or more embodiments of the invention described above, minimal manual intervention is required to raise and lower an antenna 110 (tower 104). In particular, an operator is not required to disconnect and re-make RF connections to raise or lower a tower, thus allowing for rapid emplacement and tear-down (e.g., road-march) of equipment in general. Essentially, the only manual intervention required is to mount the cable reel 120, and attach the cables 130/131. The remainder of the operation of the cable reel may be automatic in response to raising and lowering the antenna/tower.

Figure 8:
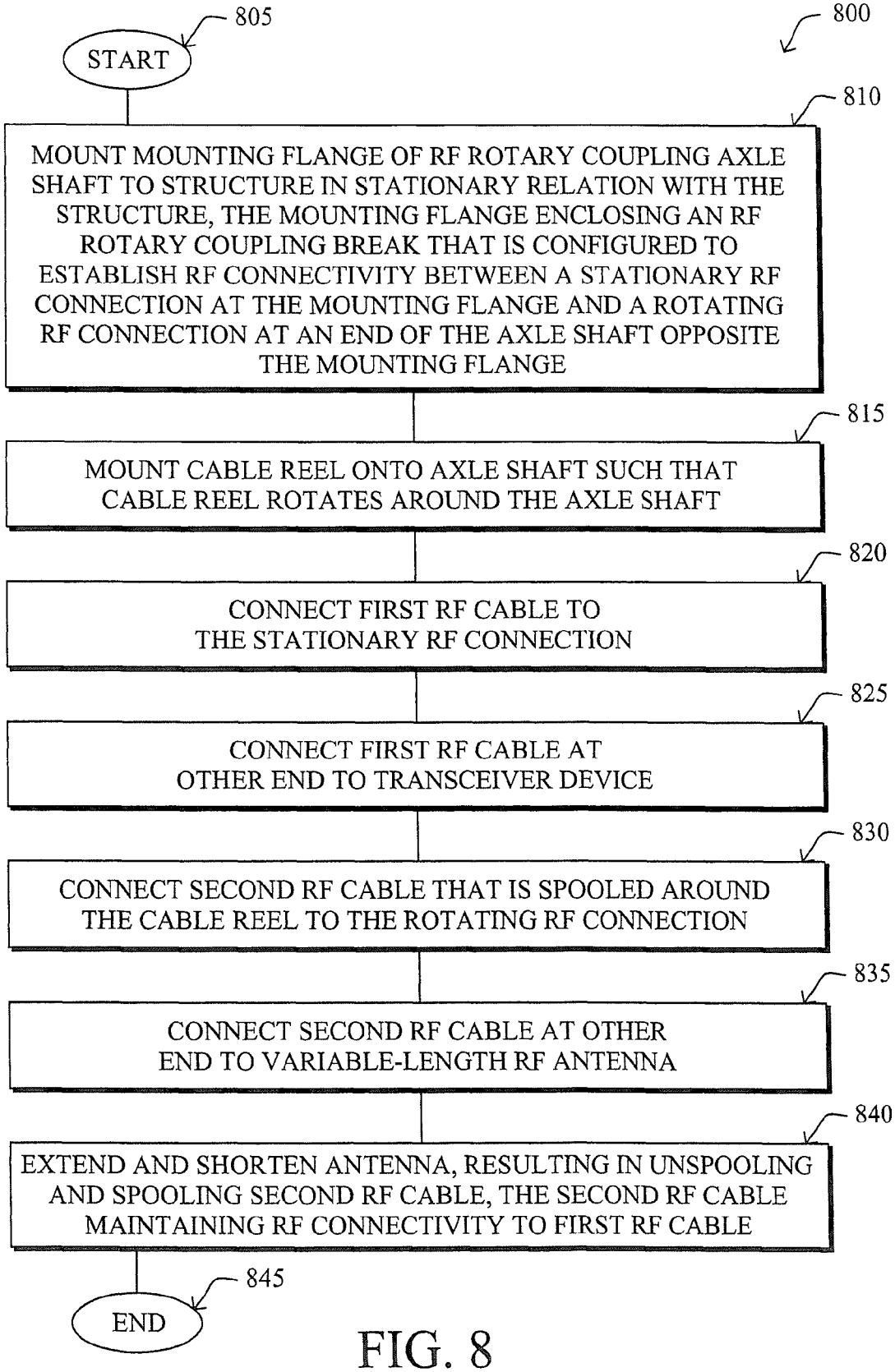
FIG. 8 illustrates an example simplified procedure for using a cable reel assembly with an RF rotary coupling axle shaft.

FIG. 8 illustrates an example simplified procedure for using a cable reel axle shaft 200 with an integrated rotary coupling as described above. The procedure 800 starts at step 805, and continues to step 810, where an operator (e.g., an installer) mounts the mounting member 205 (e.g., mounting flange) of an RF rotary coupling axle shaft 200 to a structure 102 in stationary relation with the structure. Specifically, as described above, the mounting member encloses an RF rotary coupling break 226 that is configured to establish RF connectivity between a stationary RF connection 222 at the mounting member and a rotating RF connection 224 at an end of the axle shaft (pipe 210) opposite the mounting member. In step 815, an operator (e.g., the same operator or different operator from step 810) may mount a cable reel 120 onto the axle shaft 200 such that cable reel rotates around the axle shaft. Note that steps 810 and 815 may be interchangeably ordered, such that the reel and axle are mounted as a pre-assembled unit to the structure.

Steps 820-835 describe an illustrative order of RF cable connections that may be made by an operator. Notably, steps 820-835 may be performed in any order, and the order shown is merely one illustrative example. In particular, in step 820 an operator connects a first RF cable 131 to the stationary RF connection 222, and connects the other end of the first RF cable 131 to a transceiver device (note also that the transceiver device may already be connected to the first RF cable 131 at the time the cable reel 120 is mounted to the axle in step 815). Additionally, in step 830 an operator connects a second RF cable 130 that is spooled around the cable reel 120 to the rotating RF connection 224, and also connects the second RF cable 130 at its other end to a variable-length RF antenna 110 in step 835.

Once these connections have been made (e.g., after mounting the reel to the structure 102), the antenna 110 (tower 104) may be extended and shortened in step 840, without having to disconnect and re-make RF connections made in steps 820-835 above. In other words, in step 840, the second RF cable 130 spools and unspools in response to raising and lowering the tower/antenna, and maintains RF connectivity to the first RF cable 131 through the axle shaft 200 with integrated rotary coupling as described above. The procedure 800 ends in step 845, such as when the antenna no longer needs to be raised or lowered (e.g., during transport). Note that if the RF rotary coupling axle shaft 200 has already been mounted to the structure 102 in step 810, a different operator, such as one mounting or exchanging cable reels 120, may begin the procedure 800 at step 815. Also, if the RF connections have already been made in steps 820-835, a different operator, such as one relocating mobile antenna equipment, may simply perform step 840 to adjust the length/height of the antenna 110, accordingly.

Advantageously, the novel techniques described herein provide for a cable reel axle shaft with an integrated rotary coupling. In particular, integrating a rotary coupling within the cable reel axle shaft eliminates the need for an external housing and additional seals, and greatly alleviates the physical size and weight difficulties of attaching an RF rotary coupling to an automated cable reel, e.g., used to deploy coaxial RF cable. Specifically, the combined assembly has a reduced size and weight, compared to individual components and compared especially to low frequency slip rings, and such reduced size and weight are critical for mobile communication applications. In addition, the integration provides for improved RF performance, with reduced RF line loss from the rotor to the stator connector on account of fewer interfaces as well as due to dielectric materials (e.g., air) used in the rotary coupling. Further, the illustrative structure of the axle shaft and mounting member provide for improved survivability for lightning strikes, EMP events, etc. Moreover, the techniques herein require minimal operator participation, e.g., such that the operator is not required to disconnect and remake RF connections to raise or lower a tower, and allow for rapid emplacement and tear-down (e.g., road-march) of equipment in general.

While there have been shown and described illustrative embodiments of a cable reel axle shaft with an integrated rotary coupling, it is to be understood that various other adaptations and modifications may be made within the spirit and scope of the embodiments herein. For example, the embodiments have been shown and described herein with the rotor-stator coupling break within the mounting member. However, the embodiments in their broader sense are not so limited, and may, in fact, locate the actual break anywhere within the axle shaft itself, where size constraints permit. Also, while the RF rotary coupling break is generally described herein for a single RF channel, appropriate configurations may be made to the break (e.g., and the connections) to allow for multi-channel RF couplings, accordingly. For instance, while these couplings may contain increased RF coupling complexity, these particular embodiments remain within the scope of the invention as broadly described herein with reference to the single channel example, as may be appreciated by those skilled in the art. Moreover, while the rotating RF connection 224 is shown extending through the cable reel 120 to protrude from the other side, the rotating RF connection 224 need not protrude, and may be located within the center aperture 121 of the cable reel (thus having an operator reach into the cable reel to attach the cable 130). As such, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. An apparatus, comprising:

a mounting member having a first and second side, the first side configured to mount to a structure in stationary relation with the structure;

an axle shaft having a first end and a second end, the first end affixed to the second side of the mounting member, the axle shaft configured to mate with a center aperture of a cable reel such that the cable reel rotates around the axle shaft;

a stationary radio frequency (RF) connection at the first side of the mounting member;

a rotating RF connection at the second end of the axle shaft; and an RF rotary coupling break enclosed within one of either the mounting member or the axle shaft, the rotary coupling break configured to establish RF connectivity between the stationary RF connection and the rotating RF connection.

2. The apparatus as in claim 1, further comprising:

a bracket attached to the rotating RF connection and configured to attach to the cable reel, wherein the bracket is configured to transfer rotational force from the cable reel to the rotating RF connection.

3. The apparatus as in claim 1, further comprising:

a spring-loading connection configured to attach to a spring to spring-load the cable reel.

4. The apparatus as in claim 3, wherein the spring-loading connection is a first substantially straight groove located axially along an exterior wall of the axle shaft and configured to accept a pin inserted between the first substantially straight groove and a second substantially straight groove located axially along an interior wall of a mating spring shaft to lock the spring shaft substantially in place with relation to the axle shaft.

5. The apparatus as in claim 1, wherein the RF rotary coupling break is configured for a single RF channel.

6. The apparatus as in claim 1, wherein the rotating RF connection comprises a coaxial connection that extends through the axle shaft, the apparatus further comprising:

an air dielectric within the axle shaft between an external shield of the coaxial connection and a center conductor of the coaxial connection.

7. The apparatus as in claim 1, wherein the axle shaft and mounting member each comprise a conductive material.

8. The apparatus as in claim 7, wherein the conductive material of the axle shaft is configured to conductively attach to an external coaxial shielding of an RF cable via the rotating RF connection.

9. The apparatus as in claim 1, further comprising:

seal seats at the first end and second end of the axle shaft configured to accept corresponding seals with respect to the cable reel.

10. The apparatus as in claim 1, wherein the mounting member is a flange.

11. A system, comprising:

a cable reel having a center aperture about a rotating axis of the cable reel; and a radio frequency (RF) rotary coupling axle shaft configured to mate with the center aperture of the cable reel such that the cable reel rotates around the axle shaft, the axle shaft having a first end and a second end, the axle shaft comprising:

a mounting member configured at the first end to mount to a structure in stationary relation with the structure;

a stationary RF connection at the first end;

a rotating RF connection at the second end; and an RF rotary coupling break enclosed within the mounting member and configured to establish RF connectivity between the stationary RF connection and the rotating RF connection.

12. The system as in claim 11, further comprising:

an RF cable spooled around the cable reel, the RF cable connected to the rotating RF connection.

13. The system as in claim 12, further comprising:

a variable-length RF antenna, wherein the RF cable is attached to the variable-length RF antenna at a distal end from the cable reel.

14. The system as in claim 13, further comprising:

a mobile antenna platform on which the variable-length antenna is mounted.

15. The system as in claim 11, further comprising:

a bracket attached to the rotating RF connection and configured to attach to the cable reel, wherein the bracket is configured to transfer rotational force from the cable reel to the rotating RF connection.

16. The system as in claim 11, further comprising:

a spring attached to the axle shaft and cable reel to spring-load the cable reel.

17. The system as in claim 16, wherein the axle shaft comprises a first substantially straight groove located axially along an exterior wall of the axle shaft, and wherein the spring comprises a spring shaft having a second substantially straight groove located axially along an interior wall of the spring shaft, the system further comprising:

a pin inserted between the first substantially straight groove and the second substantially straight groove to lock the spring shaft substantially in place with relation to the axle shaft.

18. The system as in claim 11, further comprising:

a first seal between the axle shaft and the cable reel at the first end of the axle shaft; and a second seal between the axle shaft and the cable reel at the second end of the axle shaft.

19. The system as in claim 11, further comprising:

a second mounting member attached to the cable reel approximate to the second end of the axle shaft, the second mounting member configured to establish rotating attachment of the cable reel to the structure.

20. A method, comprising:

mounting a cable reel onto a radio frequency (RF) rotary coupling axle shaft such that the cable reel rotates around the axle shaft;

mounting a mounting member of the axle shaft to a structure in stationary relation with the structure, the mounting member enclosing an RF rotary coupling break that is configured to establish RF connectivity between a stationary RF connection at the mounting member and a rotating RF connection at an end of the axle shaft opposite the mounting member;

connecting a first RF cable that is spooled around the cable reel to the rotating RF connection; and connecting the first RF cable at an end opposite the rotating RF connection to a variable-length RF antenna.

21. The method as in claim 20, further comprising:

connecting a second RF cable to the stationary RF connection.

* * * * *